United States Patent [19]

Zboralski

[11] 4,399,741

[45] Aug. 23, 1983

[54] METHOD OF CONTROLLING ROOM AIR FLOW INTO A FUME HOOD

[75] Inventor: Jon A. Zboralski, Manitowoc, Wis.

[73] Assignee: Hamilton Industries, Inc., Two Rivers, Wis.

[21] Appl. No.: 103,664

[22] Filed: Dec. 14, 1979

[51] Int. Cl.[3] ..... F23J 11/00

[52] U.S. Cl. ..... 98/115 LH; 137/607

[58] Field of Search ..... 98/115 R, 115 LH, 115 VM, 98/116; 137/607; 126/287; 110/158; 49/95, 96, 100; 160/222, 223; 55/419, DIG. 36

[56] References Cited

U.S. PATENT DOCUMENTS

| | | | |
|---|---|---|---|
| 1,063,619 | 6/1913 | Thomson | 126/287 |
| 1,479,339 | 1/1924 | Torgerson | 49/69 X |
| 2,715,359 | 8/1955 | Mackintosh et al. | 98/115 LH |
| 3,111,077 | 11/1963 | Cortright | 98/115 LH |
| 3,604,333 | 9/1971 | Nelson | 98/115 LH |
| 3,752,056 | 8/1973 | Chamberlin et al. | 98/115 LH |
| 4,023,473 | 5/1977 | Russell | 98/115 LH |
| 4,142,458 | 3/1979 | Duym | 98/115 LH |
| 4,177,718 | 12/1979 | Grow et al. | 98/115 LH |

*Primary Examiner*—Albert J. Makay
*Assistant Examiner*—Harold Joyce
*Attorney, Agent, or Firm*—Tilton, Fallon, Lungmus

[57] ABSTRACT

A method of controlling room air flow into a horizontal sash type laboratory fume hood. The method includes laterally moving a damper across a room air vent by means of horizontal motion of the sash so that the vent opens and closes in an inverse manner to the sash.

3 Claims, 13 Drawing Figures

METHOD OF CONTROLLING ROOM AIR FLOW INTO A FUME HOOD

BACKGROUND

U.S. Pat. No. 2,715,359 describes a horizontal sash type laboratory fume hood with a room air vent therebelow. A vertically slidable damper is actuated by horizontal motion of the sash by means of a sprocket, chain, and counter-balancing weight system, as shown in FIG. 4 of this patent. Such complicated mechanical linkage is cumbersome and expensive to manufacture and maintain. A slippage in a sprocket cog can cause the damper to be unbalanced and thus bind in its vertical track.

U.S. Pat. No. 3,604,333 describes a laboratory fume hood with a horizontally sliding sash, which in effect has an upper extension of the sash that opens an auxiliary air channel to the room as the sash is opened. Conversely, as the sash is closed, the auxiliary air passage to the room is shut off. The damper of this patent is limited in its usefulness to the very special purpose of controlling auxiliary air flow into the room because it operates directly with the sash; i.e., opens when the sash is open, and closes when the sash is closed. Such damper system would be inoperative to increase room air flow through a vent as a horizontal sash was closed, and decrease room air flow through such vent as the horizontal sash was opened. In U.S. Pat. No. 4,142,458, a horizontally sliding panel 18 has been connected to a conventional, vertical, sash type fume hood. However, the vertical movement of the main vertical sash of this patent opens and closes the room air vent, as is done in other conventional, vertical, sash type fume hoods.

SUMMARY OF THE INVENTION

The present invention provides a simple, reliable method of controlling the room air vent into a laboratory fume hood by means of horizontal sliding motion of the sash. The horizontal sash is operatively connected to a laterally movable damper that opens the room air vent as the sash is closed and closes the room air vent as the sash is opened. Preferably, the damper and sash function in this inverse manner in a progressive opening and closing of the vent and sash is such that the vent can be partially opened and the sash partially closed, for example.

RELATED APPLICATIONS

The following co-pending, co-owned applications are related. Zboralski, "Fume Hood With Dual Room Air Inlet Systems, " filed Dec. 14, 1979, Ser. No. 103,663; Zboralski, "Horizontal Sash Fume Hood With Auxiliary Air Control," filed Dec. 14, 1979, Ser. No. 103,665; and Zboralski, "Method of Controlling Auxiliary Air in Horizontal Sash Fume Hood," filed Dec. 14, 1979, Ser. No. 103,666 now abandoned.

THE DRAWINGS

DETAILED DESCRIPTION

Figure 1:
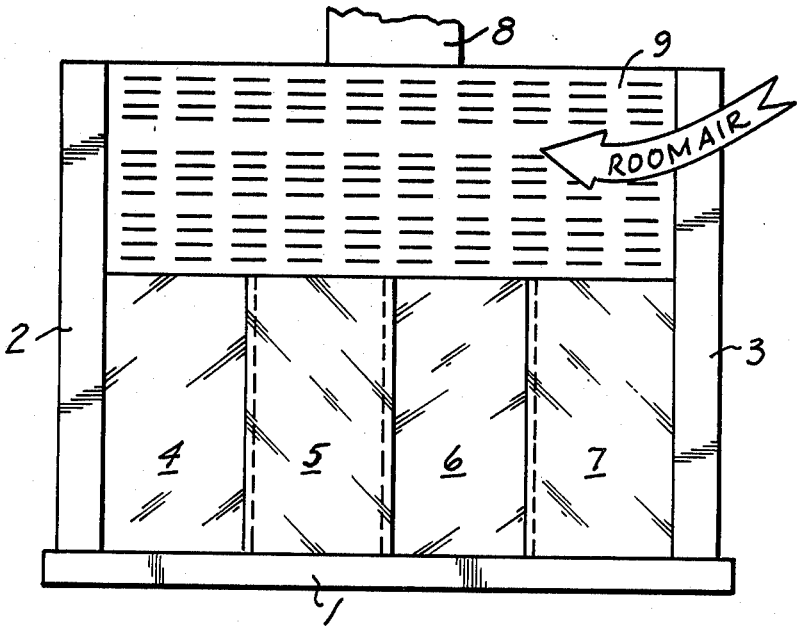
FIG. 1 is a front elevational view of a first embodiment of the invention showing a four panel horizontal sash fume hood with sash closed.

FIG. 1 is a typical laboratory fume hood with a base 1, side walls 2 and 3, and a series of horizontally sliding sashes 4, 5, 6, and 7. Although these panels are preferably of a transparent glass material, vertical dotted lines on the panels have been used to indicate panels 5 and 7 are in front of panels 4 and 6. As is well-known, these panels can horizontally slide on a track system.

When the sashes are closed as shown in FIG. 1, and the fume hood is drawing exhaust air through exhaust duct 8, it is important that the fume hood be vented to the room air. This is so air can be swept out of the fume hood through exhaust duct 8 without creating a substantial internal vacuum within the fume hood. Such room air vent system is well-known in horizontal type sash fume hoods and is preferably closed by a vent grill 9.

Even though the use of a room air vent is known, the actual control of such vent has been a problem in the past because it must be opened and closed in an inverse manner to the horizontally moving sash. With vertical sash fume hoods, the sash itself can be vertically raised to progressively close off the vent directly above the work area. Downward movement of the vertical sash to close off the work area automatically opens the room air vent. However, such construction is not operative for controlling a room air vent directly above a horizontally movable sash. The problem is further complicated in that in a horizontal sash type fume hood there are several sash panels horizontally moving relative to each other as opposed to a single sash in vertical sash type fume hoods.

Figure 2:
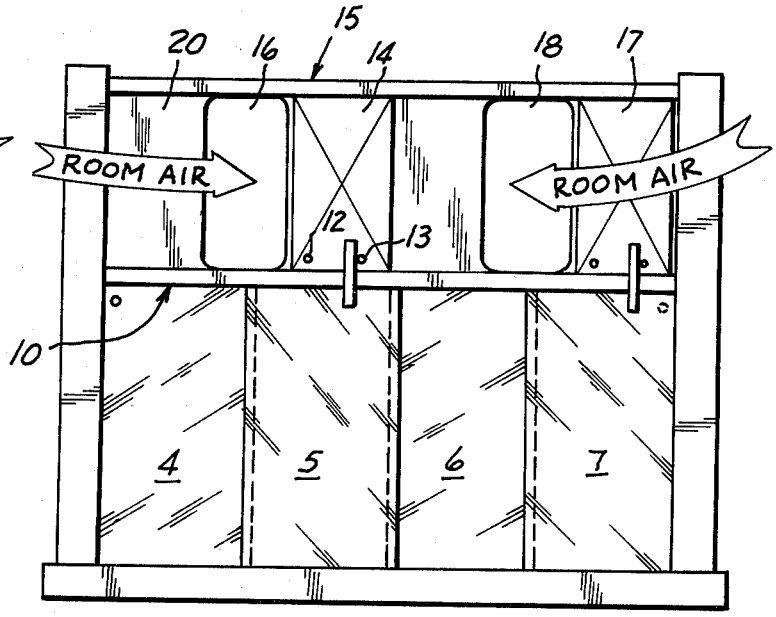
FIG. 2 is a front elevational view similar to FIG. 1, but with a vent grill removed.

Applicant's invention provides a unique fume hood, as illustrated in the first embodiment in FIGS. 1 and 2 with four horizontally movable sash panels. As shown in FIG. 2, sash 5 is suspended from a track 10 and has an upstanding bar member 11 which can engage protruding abutment members 12 and 13 of a damper panel 14. Thus, as sash panel 5 moves to the left and right in FIG. 2, it can contact abutment members 12 and 13 to also laterally move damper panel 14. Preferably, damper panel 14 moves in a horizontal direction and is maintained between an upper track system and a lower track system shown generally at 15 and 10. The purpose of the space between abutment numbers 12 and 13 is so that the panel 5 can travel horizontally a given distance prior to moving damper panel 14. This allows the sash panel 5, which is wider than damper panel 14, to open and close while moving damper panel 14 a smaller distance to open and close a vent passage 16 that is narrower than sash panel 5. It should be understood that panel 7 is coupled through a bar member to damper panel 17 in the same manner as is sash panel 5 for opening and closing the vent passage 18.

In the previous paragraph, the relationship with the forwardmost panels 5 and 7 was described relative to their particular damper panels 14 and 17. Sash panels 4 and 6, sliding behind sash panels 5 and 7, also have their own respective damper panels which slide along a rear surface of wall panel 20. Thus, the vent passages 16 and 18 can be closed by damper panels on either side of wall panel 20.

Figure 3:
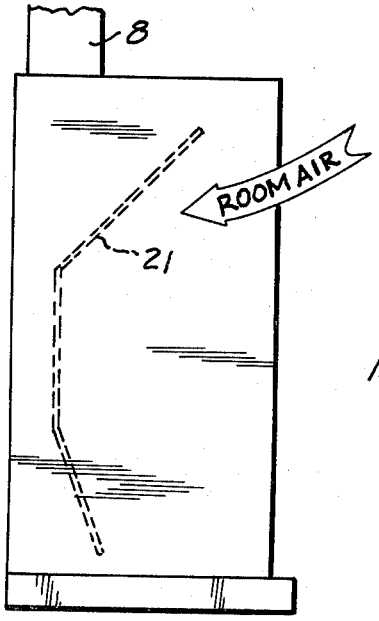
FIG. 3 is a left end elevational view of FIG. 2.

As shown schematically in FIG. 3, when the sash panels are completely closed, all room air enters through the vent system. The dotted line 21 indicates typical deflector panels within the fume hood.

Figure 5:
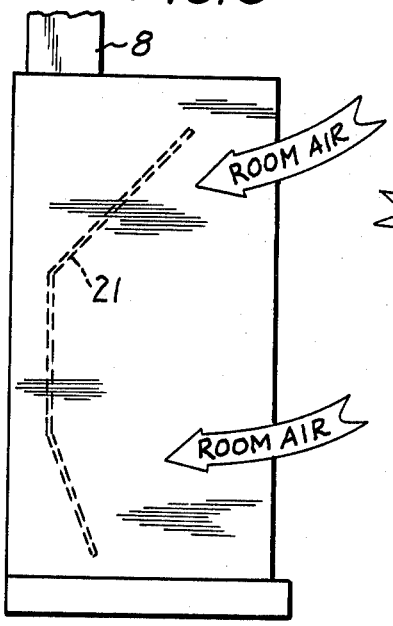
FIG. 5 is a left end elevational view of FIG. 4.
Figure 4:
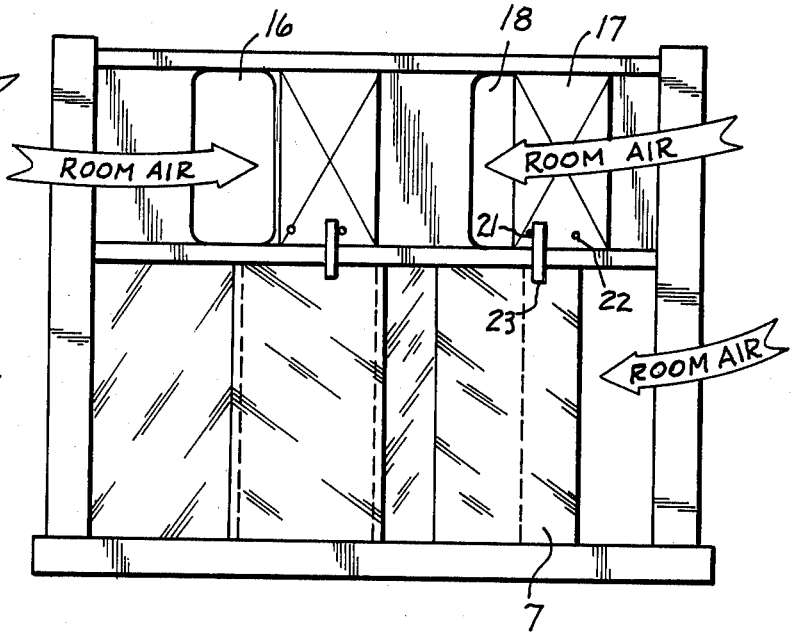
FIG. 4 is a front elevational view of the fume hood showing the right sash panel partially opened.
Figure 6:
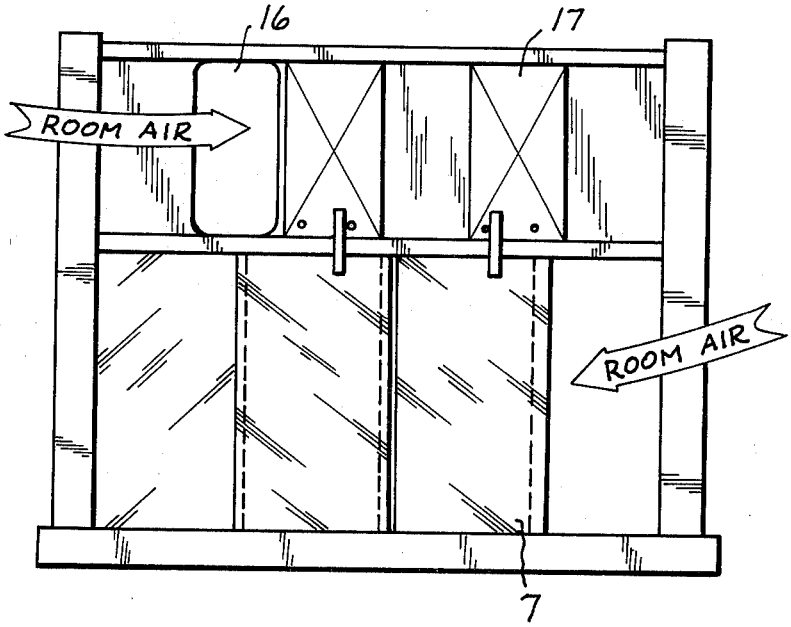
FIG. 6 is a front elevational view of the fume hood showing the right sash panel completely open.

In FIG. 4, panel 7 has been partially opened, causing bar member 23 to engage protrusion 21 on panel 17. Panel 17 has been moved to the left to partially close vent passage 18. Thus, it can be seen that as the sash panel 7 is progressively opened, the vent passage 18 is progressively closed. Likewise, as the sash panel is closed, vent passage 18 is progrossively opened. As schematically shown in FIG. 5, room air enters both the vent system and the sash opening of the fume hood of FIG. 4. In FIG. 6, when sash panel 7 is completely open, the vent panel 17 completely closes off vent passage 18.

Figure 8:
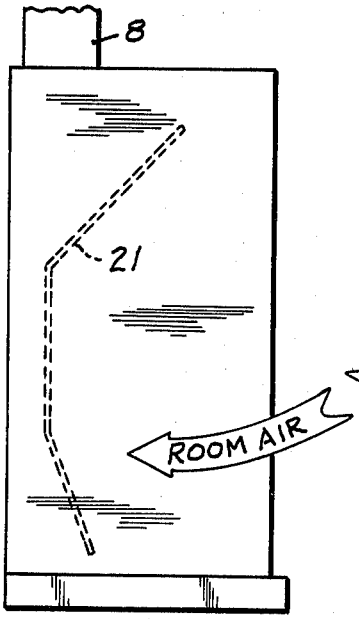
FIG. 8 is a left elevational view of FIG. 7.
Figure 7:
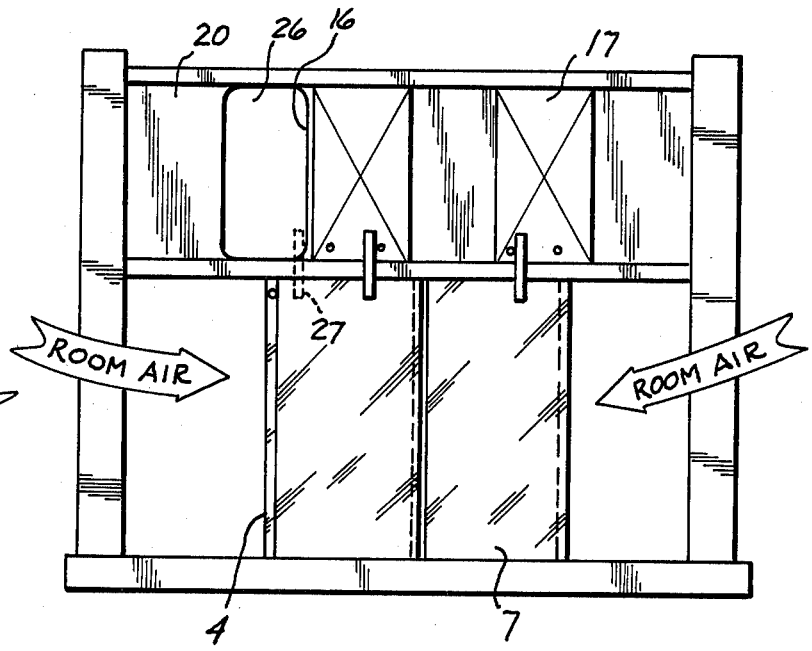
FIG. 7 is a front elevational view of the fume hood showing the left and right sash panels open.

In FIG. 7, end sash panels 4 and 7 are completely open. This causes panel 17 to completely close off vent passage 18. Also, panel 26, located behind wall panel 20 and coupled by bar member 27 to sash panel 4, closes off vent opening 16. Thus, as shown schematically in FIG. 8, all of the room air enters through the sash opening in that both vent passages are closed.

Figure 9:
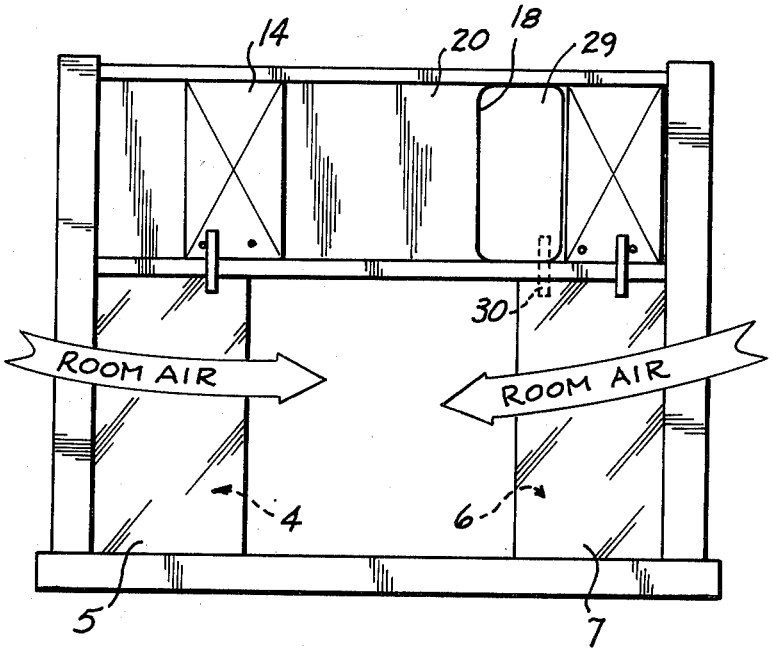
FIG. 9 is a front elevational view of the fume hood showing the two middle sash panels completely opened.

In a different opening configuration of the fume hood shown in FIG. 9, sash panel 5 has been moved to the left to be in front of sash panel 4. Also, sash panel 6 has been horizontally moved behind sash panel 7. This leaves a large open central space in the sash for work access. In FIG. 9, damper panel 14 closes off vent passage 16 and damper panel 29 secured to sash panel 6 by bar member 30 closes off vent passage 18. It is understood that damper panel 29 is behind wall panel 20.

Figure 10:
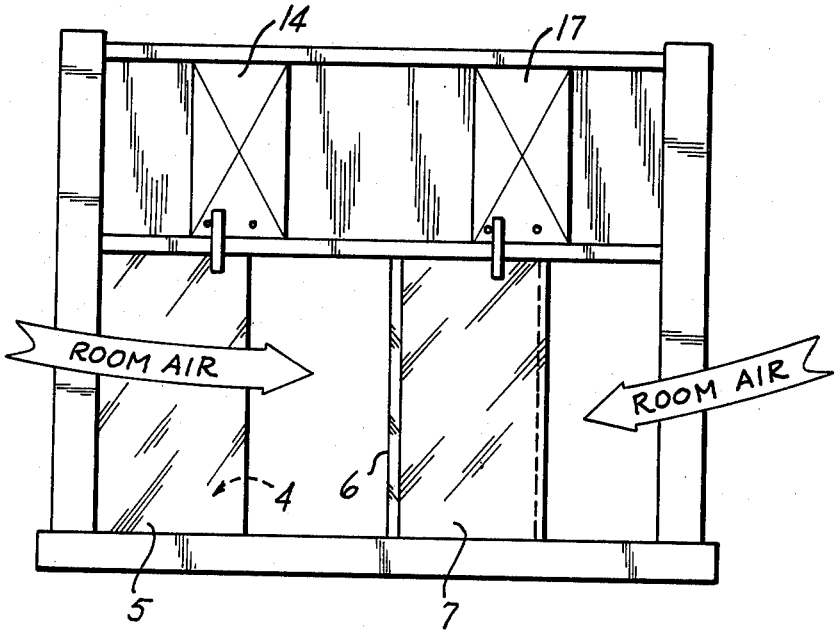
FIG. 10 is a front elevational view of the fume hood showing the second and fourth sash panels open.

FIG. 10 shows still a different opening configuration of the sash panel. Here sash panel 5 has been moved to the left in front of sash panel 4. Also, sash panel 7 has been moved to the left to remain in front of sash panel 6. This causes the room air vents 16 and 18 to be closed off by damper panels 14 and 17.

Figure 11:
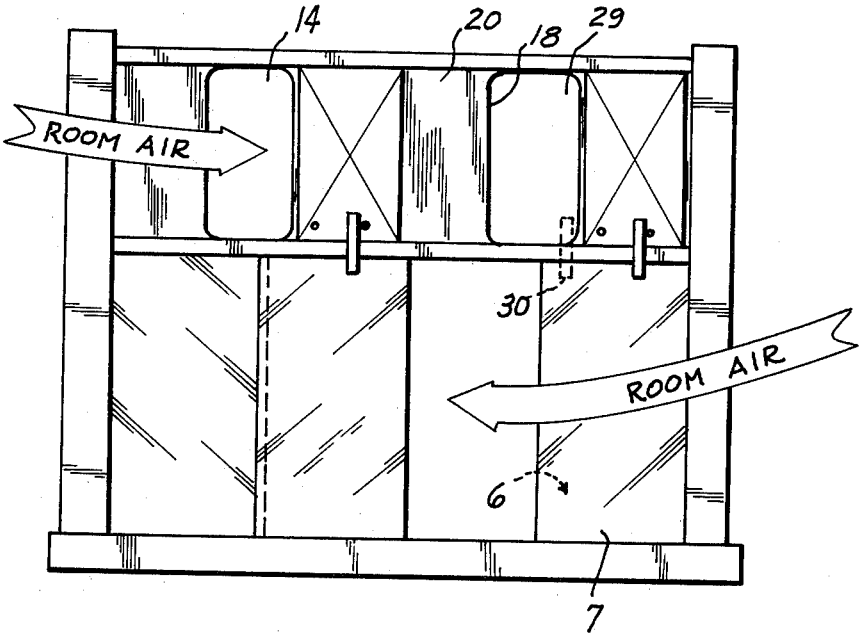
FIG. 11 is a front elevational view of the fume hood showing the third sash panel completely open.

In FIG. 11, sash panel 6 has been moved to the right so as to remain behind sash panel 7. This causes damper panel 29, located behind wall panel 20, to close off vent passage 18. Vent passage 14 remains open so that room air can enter the vent system and the sash opening.

In the preceding drawings, FIGS. 1–11, a first embodiment has been shown which has four sash panels and two separate vent passages. Such fume hood construction would work very well for a fume hood that was approximately 6 feet wide. In narrower fume hoods, such as in 4 foot widths, only two sash panels and a single vent passage can be used, as shown in the second embodiment of this invention depicted in FIGS. 12 and 13. It is understood that any number of sashes and any width of fume hoods could be constructed if desired.

Figure 12:
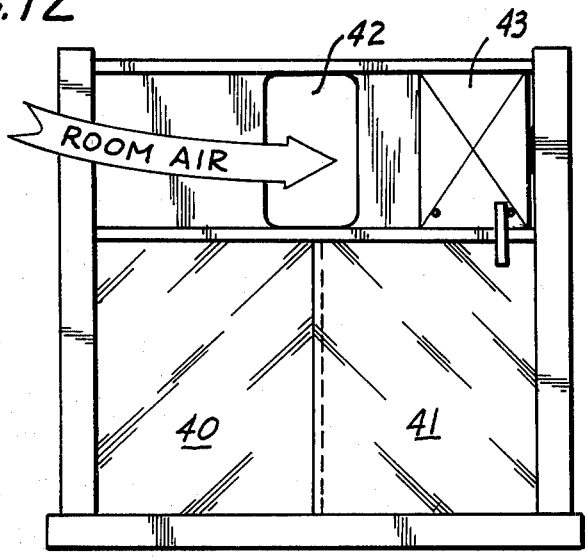
FIG. 12 is a front elevational view of the second embodiment of the fume hood having two sash panels that are closed and with the vent grill removed.
Figure 13:
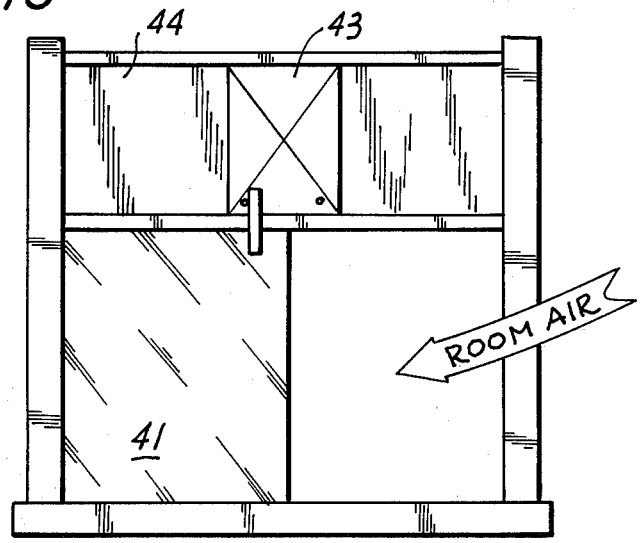
FIG. 13 is a front elevational view of the fume hood of FIG. 12 showing the right sash panel completely open.

In FIG. 12, a sash panel 40 and a sash panel 41 horizontally move on a track system similar to that of the first embodiment. Here a vent passage 42 is opened by the closure of the horizontally slidable sash panels 40 and 41. In FIG. 13, when the panel 41 is moved to the left to open the sash, damper panel 43 closes off vent passage 42. If both sash panels 40 and 41 were moved to the right of FIG. 13, a similar damper panel (not shown) connected to a corresponding bar member to sash panel 40 behind wall panel 44 would correspondingly move to the right to close off vent opening 42.

In the foregoing description, specific examples have been used to describe the invention. However, it is understood by those skilled in the art that certain modifications can be made to these embodiments without departing from the spirit and scope of the invention.

I claim:

1. A method of controlling room air flow into a fume hood having a horizontally slidable sash and a room air vent comprising the steps of:

(a) horizontally sliding the sash to change a sash passage into the hood; and (b) transmitting at least a portion of the sash's sliding movements to the left and at least a portion of the sash's sliding movements to the right into lateral movements of a damper moving the damper across the vent to change a vent passage in an inverse manner to the change in a sash passage;

wherein the method includes progressively opening and closing the sash while progressively closing and opening the damper, and further includes moving the sash a given horizontal distance before moving the damper, whereby the total travel of the sash is greater than the damper travel.

2. A method as set forth in claim 1, wherein the method includes moving a bar member on one of the sash and damper between two laterally spaced abutment members on the other of the sash and damper.

3. A method as set forth in claim 2, wherein the method includes moving a bar member on the sash into engagement with abutment members on the damper.

* * * * *